US012344446B2

(12) United States Patent
Polier et al.

(10) Patent No.: US 12,344,446 B2
(45) Date of Patent: Jul. 1, 2025

(54) CONTAINER HAVING OUTER SLEEVE AND INNER TRAY WITH LOCKING MECHANISM

(71) Applicant: PHILIP MORRIS PRODUCTS S.A., Neuchatel (CH)

(72) Inventors: Julie Polier, Neuchatel (CH); Luiz Andre Rodrigues, Neuchatel (CH); Digvijay Singh, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 96 days.

(21) Appl. No.: 17/767,131

(22) PCT Filed: Oct. 6, 2020

(86) PCT No.: PCT/EP2020/077949

§ 371 (c)(1),
(2) Date: Apr. 7, 2022

(87) PCT Pub. No.: WO2021/069414

PCT Pub. Date: Apr. 15, 2021

(65) Prior Publication Data

US 2022/0371769 A1 Nov. 24, 2022

(30) Foreign Application Priority Data

Oct. 7, 2019 (EP) ..... 19201793

(51) Int. Cl.
*B65D 5/38* (2006.01)
*B65D 5/72* (2006.01)
(Continued)

(52) U.S. Cl.
CPC ..... *B65D 5/38* (2013.01); *B65D 5/728* (2013.01); *B65D 77/0433* (2013.01); *B65D 77/2024* (2013.01); *B65D 85/10* (2013.01)

(58) Field of Classification Search
CPC . B65D 7/10; B65D 9/08; B65D 11/12; B65D 2583/0468; B65D 77/2024; B65D 2215/04; A24F 15/12
(Continued)

(56) References Cited

U.S. PATENT DOCUMENTS 2,231,726 A 2/1941 Locke, Jr.
2,541,173 A * 2/1951 Moore ..... B65D 5/38 229/162.1

(Continued)

FOREIGN PATENT DOCUMENTS

DE 102008040046 6/2011
JP 2012-526025 10/2012

(Continued)

OTHER PUBLICATIONS

Communication issued in Europe for Application No. 19201793.7 dated Jan. 31, 2020 (10 pages).

(Continued)

*Primary Examiner* — Mollie Impink
(74) *Attorney, Agent, or Firm* — Mueting Raasch Group

(57) ABSTRACT

A container (1) for consumer goods, the container comprises an outer sleeve (20) and inner tray (10) disposed within the outer sleeve (20), and configured to slide within the outer sleeve (20) between: a first position, in which the interior of the inner tray (10) cannot be accessed by a user; and a second position, in which the interior of the inner tray (10) can be accessed by a user. The container (1) has a locking mechanism for preventing the inner tray (10) from sliding with respect to the outer sleeve from the first position to the second position, when the inner tray (10) is in the first position in the outer sleeve (20).

16 Claims, 3 Drawing Sheets

(51) Int. Cl.
*B65D 77/04* (2006.01)
*B65D 77/20* (2006.01)
*B65D 85/10* (2006.01)

(58) Field of Classification Search
USPC ..... 229/123.1, 129.1
See application file for complete search history.

(56) References Cited

U.S. PATENT DOCUMENTS

| | | | | |
|---|---|---|---|---|
| 8,727,205 | B2 * | 5/2014 | Wipf | B65D 5/38 229/123.1 |
| 2012/0043323 | A1 | 2/2012 | Thomas | |
| 2013/0140201 | A1 * | 6/2013 | Ghini | B65D 85/1036 206/267 |
| 2015/0048001 | A1 * | 2/2015 | Bailey | B65D 77/0433 206/468 |
| 2020/0180808 | A1 * | 6/2020 | Gauvin | B65D 5/38 |

FOREIGN PATENT DOCUMENTS

| | | |
|---|---|---|
| WO | WO 2018/122108 | 7/2018 |
| WO | WO 2021/032619 | 2/2021 |
| WO | WO 2021/032621 | 2/2021 |
| WO | WO 2021/032622 | 2/2021 |

OTHER PUBLICATIONS

PCT Search Report and Written Opinion for PCT/EP2020/077949 dated Nov. 9, 2020 (11 pages).
Office Action issued in Japan for Application No. 2022-518940 dated Jul. 23, 2024 (13 pages). English translation included.

* cited by examiner 10
70
50
40
1
10
70
50
40
1
10
50
80
81
21
21
24
1
30

CONTAINER HAVING OUTER SLEEVE AND INNER TRAY WITH LOCKING MECHANISM

This application is a U.S. National Stage Application of International Application No. PCT/EP2020/077949 FILED Oct. 6, 2020, which was published in English on Apr. 15, 2021, as International Publication No. WO 2021/069414 A1. International Application No. PCT/EP2020/077949 claims priority to European Application No. 19201793.7 filed Oct. 7, 2019.

The present invention relates to a container for consumer goods. Containers according to the invention find particular application as containers for aerosol generating articles or components of aerosol generating articles.

It is known to package consumer goods in containers comprising an outer shell or sleeve and an inner tray in which the consumer goods are housed and which is slidable within the outer shell. To remove consumer goods from such containers, a user slides the inner slide from an initial position within the outer shell to an open position in which the inner slide projects outwardly from the outer shell, in order to partially expose an open end or side of the inner slide. Such containers may be referred to as a slide-and-shell container.

It may be desirable to ensure that the inner slide or inner tray remains enclosed within the outer shell until a user intends to access the consumer goods. For example, it may be desirable to ensure that the inner tray remains in the closed position when the container is being transported. The ensured closure may help to prevent the consumer goods from inadvertently falling out of the container. Preventing an accidental opening of the container may help to preserve one or more properties of the consumer goods, such as their freshness.

It would be desirable to provide a novel and improved container for consumer goods which is configured to reduce the risk of the inner tray inadvertently moving from the closed position to the open position. Further, it would be desirable to provide one or more laminar blanks for forming one such improved container, wherein the manufacturing process is straightforward and cost-effective.

According to the present disclosure, there is provided a container for consumer goods. The container comprises an outer sleeve. The outer sleeve comprises an outer sleeve top wall, an outer sleeve bottom wall, first and second opposed outer sleeve side walls, and a first open end. The container comprises an inner tray disposed within the outer sleeve. The inner tray comprises a recessed base having an interior for housing consumer goods. The container comprises a cover member. The cover member comprises a first portion overlying the recessed base of the inner tray, and a second portion extending beyond the recessed base. The second portion of the cover member is affixed to the outer sleeve. The inner tray is slidable with respect to the outer sleeve between: a first position, in which the cover member and the recessed base form an enclosure for consumer goods; and a second position, in which the interior of the recessed base can be accessed by a user. Sliding of the inner tray from the first position to the second position involves at least part of the inner tray passing through the first open end of the outer sleeve. Sliding of the inner tray from the first position to the second position also involves at least a portion of the cover member being peeled away from the recessed base to expose the interior of the inner tray. The inner tray further comprises an inner tray engagement flap. When the inner tray is in the first position in the outer sleeve, an edge of the inner tray engagement flap is configured to engage with a corresponding engaging element on an outer sleeve wall, to form a locking mechanism for preventing the inner tray from sliding from the first position to the second position.

As discussed in more detail below, in some embodiments, the engaging element on the outer sleeve wall is formed by a holding panel connected to the outer sleeve wall by a fold line at the first open end of the outer sleeve top wall, and folded around the fold line such that the holding panel is positioned under the outer sleeve top wall, and the second portion of the cover member is fixed to the holding panel.

The inner tray engagement flap and the corresponding engaging element form at least part of a locking mechanism for the container. By providing the container with such a locking mechanism the container can be left in a locked state, in which the interior of the inner tray cannot be accessed. This means that the container can be locked when not in use. The locking mechanism may therefore help to reduce the risk of inadvertent opening of the container. This may help to prevent the consumer goods from inadvertently falling out of the container. This may help to preserve one or more properties of the consumer goods, such as their freshness.

By providing the container according to the present invention, at least part of the locking mechanism may be hidden from the outer appearance of the container. This can mean that the locking mechanism is less obviously visible. This may help to reduce the risk of the container becoming inadvertently unlocked. More specifically, because the inner tray engagement flap is configured to engage with an engaging element on an inner surface of an outer sleeve wall, the inner tray engagement flap can underlie the outer sleeve wall and thus be at least partially hidden.

This may also help for large portions of the outer surface of the container to be substantially uninterrupted and smooth. This may be advantageous for one or both of transporting and manufacturing of the container. This may also be advantageous when printing the continuous outer surface of the container.

The choice of using such a locking mechanism in a container having an inner tray, which is slidable relative to an outer sleeve, can be particularly advantageous in reducing the risk of inadvertent opening of the container. This is because the action required to release the locking mechanism, may be a different action from the sliding action required to move the inner tray relative to the outer sleeve. For example, a pressing action may be required to release the locking mechanism, whereas a sliding action may be required to move the inner tray relative to the outer sleeve. The requirement for such different and distinct actions, can make it even less likely for the container to be opened inadvertently.

The choice of using such a locking mechanism in a container having slidable inner tray and a cover member covering the slidable inner tray can be particularly advantageous. In particular, the cover member and inner tray arrangement of the present invention is configured to cause the cover member to simultaneously unpeel from the inner tray as the inner tray slides from the first position to the second position. This means that as the inner tray moves out of the outer sleeve the cover member is simultaneously peeled away from the inner tray to reveal the interior of the inner tray to a user. Furthermore, as the inner tray is moved back inside the outer sleeve, the cover member is moved back over the inner tray to cover the inner tray and form an enclosure for consumer goods. The inner tray can then be held in a locked position with the consumer goods securely enclosed in the inner tray. This may help to better preserve the consumer goods. In some embodiments, the cover member and inner tray may form a sealed enclosure for consumer goods, when the inner tray is in the first position. The sealed enclosure may be provided through the use of a resealable adhesive between the cover member and the inner tray. For example, when the inner tray comprises a flange, as discussed in more detail below, the flange may be provided with a resealable adhesive for repeated sealing and unsealing of the cover member to the inner tray.

The edge of the inner tray engagement flap, which is configured to engage with a corresponding engaging element on an outer sleeve wall, is preferably a free edge of the inner tray engagement flap. A free edge of a flap is one which does not directly connect the flap to the object from which it depends.

The free edge of the inner tray engagement flap is preferably a leading edge of the inner tray engagement flap. That is, the free edge of each inner tray engagement flap configured to engage with a corresponding engaging element on an outer sleeve wall, is preferably positioned opposite to an edge of the inner tray engagement flap which connects the inner tray engagement flap to the rest of the inner tray.

The inner tray is configured to be slidable with respect to the outer sleeve. The outer sleeve may therefore have an interior configured to receive the inner tray. The outer sleeve may comprise a second end positioned opposite to the first open end of the outer sleeve. The second end of the outer sleeve may comprise an outer sleeve back wall. Therefore, the outer sleeve may have a first open end, and a second end comprising the outer sleeve back wall, with the outer sleeve top wall, outer sleeve bottom wall and first and second opposed outer sleeve side walls extending between the first open end of the outer sleeve and the back wall of the outer sleeve.

The inner tray is movable with respect to the outer sleeve between: a first position and a second position. In the first position, the cover member and the recessed base form a sealed enclosure for consumer goods. This means that, in the first position, the interior of the recessed base cannot be accessed by a user.

In the second position, the interior of the recessed base can be accessed by a user. In the second position, the cover member has been peeled away from the recessed base to expose the interior of the inner tray.

The first position may be regarded as a closed position. The second position may be regarded as an open position. When the inner tray is in the second position, the interior of the inner tray may be directly accessible for a user.

Movement of the inner tray from the first position to the second position involves at least part of the inner tray passing through the first open end of the outer sleeve. In particular, at least part of the inner tray is configured to be slidable through the first open end of the outer sleeve, and thus at least partially move out of the outer sleeve, as the inner tray moves from the first position to the second position. This can help to improve the ease of access to any consumer goods held by the inner tray, when the inner tray is in the second position.

The outer sleeve and the inner tray may be configured so that the majority or all of the inner tray is enclosed by the outer sleeve when the inner tray is in the first position. This can help to minimise the amount of surface area of the inner tray, which can be accessed by a user when the inner tray is in the first position. This may help to minimise inadvertent opening of the container.

The inner tray may comprise an inner tray front wall, an inner tray back wall, first and second opposed inner tray side walls, and an inner tray bottom wall. The inner tray front wall, the inner tray back wall, the first and second opposed inner tray side walls, and the inner tray bottom wall may together define the recessed base of the inner tray.

Where the inner tray comprises such walls, preferably, the outer sleeve and the inner tray are configured so that at least one of the inner tray bottom wall and the first and second opposed inner tray side walls completely underlies their corresponding outer sleeve bottom wall and first and second opposed outer sleeve side walls, when the inner tray is in the first position. In such embodiments, at least one of the inner tray bottom wall and first and second opposed inner tray side walls will not be visible to a user, when the inner tray is in the first position. This may help to reduce the risk of the container being inadvertently opened. This may also help to enhance the amount of uninterrupted surface area, which is available for communication with the user at one or more of the top, bottom and first and second sides of the container, when the inner tray is in the first position.

The cover member preferably has the form of a flexible sheet-like material. The cover member may be a single layer sheet or a multilayer sheet. The cover member may be a foil or comprise a layer of foil.

When the inner tray comprises an inner tray back wall, the inner tray engagement flap may depend from the inner tray back wall, and be configured to overlie the cover member. The inner tray engagement flap may extend from the back of the inner tray towards the front of the inner tray, and overlie at least a back portion of the cover member. This can advantageously mean that the locking mechanism only engages once the back of the inner tray has reached the back of the outer sleeve. This can help to ensure an efficient use of storage space. When the inner tray is in the first position, the inner tray back wall may be disposed adjacent to an outer sleeve back wall.

Preferably, the inner tray further comprises a flange extending along an upper edge of the recessed base. The first portion of the cover member may overlie only the recessed base, when the inner tray is in the first position in the outer sleeve. Preferably, the first portion of the cover member overlies both the recessed base and the flange, when the inner tray is in the first position in the outer sleeve. This may provide an effective arrangement for enclosing the consumer goods within the inner tray. In some embodiments, the flange can provide an effective means for forming a sealed enclosure for consumer goods in the inner tray, because it can provide a flat surface against which the cover member may sealed. For example, resealable adhesive may be provided on the flange of the inner tray so that the cover member can be repeatedly sealed on and peeled away from the inner tray during the closing and opening operations of the container by a user.

Arranging for the first portion of the cover member to overlie both the recessed base and the flange can be advantageous from a manufacturing perspective. For example, during manufacture, a single initial web of material could be applied across a number of interconnected recessed bases, which are then cut to form one or more recessed bases. This may reduce the need for precise alignment between the cover member and the recessed base.

The flange may extend along only part of the upper edge of the recessed base. Preferably, the flange extends along at least two sides of the upper edge of the recessed base, more preferably the flange extends along at least three sides of the upper edge of the recessed base, even more preferably the flange extends along four sides of the upper edge of the recessed base.

The flange may be formed integrally with the recessed base. One or both of the flange and the recessed base may be formed from moulded plastic. The flange may be a separate piece that is attached to the recessed base, for example, by means of an adhesive.

The recessed base may be formed of any suitable material or combination of materials. Preferably, the recessed base is formed from a plastic material.

The outer sleeve and the inner tray may be arranged so that the entirety of the recessed base is fully disposed within the outer sleeve, when the inner tray is in the first position. This can help to protect the inner tray when a consumer does not intend to access the consumer goods.

In some embodiments, part of the inner tray resides outside of the outer sleeve when the inner tray is in the first position. More specifically, in some embodiments, the inner tray further comprises a pull tab extending through the first open end of the outer sleeve, when the inner tray is in the first position in the outer sleeve. The pull tab can provide a means for a user to grip and slide the inner tray from the first position to the second position. Therefore it is possible to advantageously ensure that whilst most of the inner tray is covered by the outer sleeve, a portion of the inner tray can still be gripped by a user, when the inner tray is in the first position. This can provide a balance between securing the inner tray in a locked state, and helping a user to slide the inner tray away from the outer sleeve when access to any consumer goods within the inner tray is intended. The pull tab may extend from the recessed base. Where the inner tray comprises a flange extending along an upper edge of the recessed base, the pull tab may extend from the flange. The pull tab may be formed integrally with the flange.

In the following description of the invention the terms "side", "top", "bottom", "front", "back" and other terms used to describe relative positions of the components of containers according to the invention refer to the container in an upright position where the recessed base faces upwards. When describing containers according to the present invention, these terms are used irrespective of the orientation of the container being described. The "bottom" of the container refers to the side of the container opposite the "top" of the container.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container in accordance with the invention. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a fold line from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional components of containers in accordance with the invention, for example to a reinforcing member provided in the form of an inner frame.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container. For example, the front wall of the package has an inner surface that is facing the inside of the package and the consumer goods, and an outer surface facing away from the consumer goods. It should be noted that the inside or outside surface is not necessarily equivalent to a certain side of a blank used in assembly of the container. Depending on how the blank is folded around the consumer goods, areas that are on the same side of the blank can either face towards the inside or the towards the outside of the container.

The term "fold line" is used to describe any line of a blank about which the blank is folded. The fold line may be defined by a line of weakness to assist with the folding action. Alternatively, a fold can be formed without the presence of a weakening line, depending for example on the pliability of the blank material and other material characteristics.

When the locking mechanism of the container is engaged, the inner tray is prevented from sliding from the first position to the second position with respect to the outer sleeve. Disengagement of the locking mechanism enables the inner tray to slide with respect to the outer sleeve from the first position to the second position. Therefore, the container may be configured so that disengagement of the inner tray engagement flap from its corresponding engaging element on the outer sleeve wall, allows the inner tray to slide with respect to the outer sleeve from the first position to the second position.

The wall of the outer sleeve having the engaging element may be provided with a release element for enabling the edge of the inner tray engagement flap to disengage from the engaging element. The release element may be configured to enable the locking mechanism to transition from a locked state to an unlocked state in response to pressure exerted on the container by a user. In particular, the release element is configured to enable a user to interact with the locking mechanism to cause the locking mechanism to transition into the unlocked state. Preferably, when the inner tray is in the first position, the release element of the outer sleeve overlies at least a portion of the inner tray engagement flap.

In some embodiments, the release element may comprise a cut-out in the wall of the outer sleeve having the engaging element. The cut-out may be positioned adjacent to a portion of the inner tray engagement flap, when the inner tray is in the first position. In such embodiments, the cut-out can allow a user to directly access the inner tray engagement flap and disengage the inner tray engagement flap from the corresponding engaging element on the outer sleeve wall. In particular, a user may insert their finger through the cut-out and push the inner tray engagement flap away from the engaging element on the inner surface of the outer sleeve side wall to unlock the locking mechanism.

In some embodiments, the release element comprises a release tab formed by at least one cut line in the wall of the outer sleeve having the engaging element. For example, an outer sleeve wall may comprise a cut, which defines at least part of the perimeter of a release tab in said wall. The cut may be a U-shaped cut. The cut may be an arcuate cut. The release tab may be deflectable relative to the remainder of its outer sleeve wall. This can allow the release tab to be moved independent of its outer sleeve wall, in response to pressure from a user. The release tab may be positioned adjacent to a portion of its corresponding inner tray engagement flap, when the inner tray is in the first position. Thus, in use, a user can press on the release tab to translate a force to the inner tray engagement flap to disengage the inner tray engagement flap from the engaging element of the outer sleeve wall.

By providing a release element in the form of a release tab, the means for unlocking the locking mechanism can be incorporated into the container with minimal visual impact on the container. The means for unlocking the container may therefore not be obviously visually apparent. This may therefore help to reduce the risk of the container being inadvertently opened.

As noted above, the inner surface of an outer sleeve wall comprises the engaging element for engaging with an edge of each inner tray side flap, when the inner tray is in the first position in the outer sleeve. The engaging element provides a barrier for engaging with the inner tray engagement flap. In particular, the barrier may provide an engagement edge configured to abut the edge of the inner tray engagement flap, when the inner tray is in the first position in the outer sleeve. The engaging element may be integrally formed with its corresponding outer sleeve wall. For example, the outer sleeve wall may be manufactured with a raised portion having an increased thickness to provide the engaging element on the inner surface of the outer sleeve wall. Alternatively, the engaging element may comprise an element affixed to the inner surface of the outer sleeve wall. The element may comprise a strip of material extending across the inner surface of the outer sleeve wall.

The engaging element may be formed from a panel which is secured to part of the inner surface of the outer sleeve wall. The panel may be connected to its corresponding outer sleeve wall by a fold line, and folded about the fold line by about 180 degrees relative to its corresponding outer sleeve wall.

The wall of the outer sleeve having the engaging element may be the outer sleeve top wall.

The wall of the outer sleeve having the engaging element may be formed from a first panel and a second panel overlying the first panel. In some embodiments, this wall is the outer sleeve top wall. The first panel may define the inner surface of the wall. The second panel may define the outer surface of the wall. The engaging element may therefore be positioned on the first panel, and in particular, on the inner surface of the first panel. The engaging element may be in the form of a panel having an edge configured to abut the engagement flap of the inner tray. This panel may be referred to as an engaging panel. The edge may be provided by an external edge of the engaging panel. Alternatively, the edge may be provided by a cut-out in the engaging panel.

Where the container comprises a release tab, the release tab may be formed on the second panel. In some embodiments, the first panel comprises a cut-out. The cut-out allows the release tab to come into contact with the engagement flap of the inner tray, when the inner tray is in the first position.

The container may further comprise a holding mechanism for preventing the inner tray from entirely sliding out of the first open end of the outer sleeve. The holding mechanism may help to prevent the inner tray from being separated from the outer sleeve. The holding mechanism may prevent the inner tray from being completely removed from the outer sleeve. The holding mechanism may prevent the inner tray from sliding beyond the second position.

The holding mechanism may advantageously provide a user with an indication that the inner tray has reached the second position. More specifically, when the holding mechanism engages to prevent further sliding of the inner tray, the user may be provided with a tactile indication that the inner tray has reached the second position. This may give a user an indication that the inner tray is in a position in which they can access the consumer goods.

In some embodiments, the holding mechanism comprises an extendable member connecting a part of the inner tray to a part of the outer sleeve. The extendable member is configured to change between a retracted state when the inner tray is in the first position, and an extended state when the inner tray is in the second position. The extendable member may be provided in the form of a strip of folded panels, with a first end panel of the strip being secured to a part of the outer sleeve and a second opposing end panel of the strip being secured to a part of the inner tray. For example, the first end panel of the strip may be secured to the inner surface of an outer sleeve wall, such as an outer sleeve bottom wall. The second end panel may be secured to the outer surface of an inner tray wall, such as the inner tray back wall. The extendable member may therefore be concertina-like when it changes between its retracted and extended configurations.

In some embodiments, the holding mechanism comprises a holding element. The holding element may be disposed at the inner surface of an outer sleeve wall. The holding element may be disposed at the inner surface of the outer sleeve wall which comprises the engaging element. The holding element may comprise a holding edge. The holding edge may provide a barrier for engaging with the inner tray engagement flap, when the inner tray is in the second position. More specifically, when the inner tray reaches the second position, the holding edge at the inner surface of the outer sleeve wall may engage with the inner tray engagement flap to prevent the inner tray from entirely sliding out of the first open end of the outer sleeve.

The holding element may be integrally formed with its corresponding outer sleeve wall. For example, the outer sleeve wall may be manufactured with a raised portion having an increased thickness to provide a holding edge of a holding element on the inner surface of the outer sleeve wall. Alternatively or in addition, the holding element may be affixed to the inner surface of the outer sleeve wall. The holding element may comprise a strip of material extending across part of the inner surface of the outer sleeve wall. The material may be in the form of a panel which is secured to part of the inner surface of the outer sleeve wall.

In some embodiments, the holding element is formed from a panel connected to the outer sleeve wall by a fold line. This panel may be referred to as a holding panel. The holding panel may be folded about the fold line by about 180 degrees relative to its corresponding outer sleeve wall. The fold line may be provided at the first open end of the outer sleeve.

In some embodiments, the holding panel depends from a fold line forming an edge of the outer sleeve top wall, the edge being disposed proximate to the first open end of the outer sleeve opening.

The holding panel may be folded around the fold line and positioned under the outer sleeve top wall. The holding panel may be folded about 180 degrees around the fold line and positioned under the outer sleeve top wall. In some embodiments, the holding panel may project toward the interior of the outer sleeve, and thus toward the inner tray. This is particularly relevant when no adhesive is provided between the holding panel and the outer sleeve top wall for fixing the holding panel flush to the inner surface of the outer sleeve top wall. This may also be particularly relevant when the holding panel is formed from material having natural resilience, such as cardboard or paperboard. In such embodiments, during sliding of the inner tray from the first position to the second position, the engagement flap of the inner tray may slide into the gap between the holding panel and the outer sleeve top wall to prevent the inner tray from sliding entirely out of the first open end of the outer sleeve.

A holding element having one or more of the above described features can provide a number of advantages. For example, the holding element may be easy to manufacture, particularly if the holding element depends from one of the existing walls of the outer sleeve.

The cover member comprises a second portion affixed to the outer sleeve. The second portion of the cover member may be affixed to the wall of the outer sleeve having the engaging element. The second portion of the cover member may be affixed to the outer sleeve top wall. The second portion of the cover member may be affixed to the inner surface of the outer sleeve top wall.

Where the outer sleeve comprises a holding panel connected to the outer sleeve wall by a fold line, the second portion of the cover member may be affixed to the holding panel. This may be particularly advantageous for ensuring that the holding panel engages with the engaging flap of the inner tray when the inner tray moves towards the second position. In particular, when the inner tray moves towards the second position the cover member can pull the holding panel away from its outer sleeve wall and create space between the holding panel and the outer sleeve wall from which it depends. The engaging flap can then extend into this space as the inner tray reaches the second positon to form an engagement with the holding panel.

The cover member may comprise an inner surface and an outer surface. The inner surface of the first portion of the cover member may face towards the interior of the recessed base when the inner tray is in the first position. The inner surface of the second portion of the cover member may be affixed to a surface of the outer sleeve. For example, when the outer sleeve comprises a holding panel connected to the outer sleeve wall by a fold line, the inner surface of the second portion of the cover member may be affixed to a surface of the holding panel.

Providing a cover member where the inner surface of the first portion of the cover member faces towards the interior of the recessed base when the inner tray is in the first position, and where the inner surface of the second portion of the cover member is affixed to a surface of the outer sleeve can be advantageous. In particular, in such an arrangement a bend can be created in the cover member. The bend may help to facilitate peeling of the first portion of the cover member away from the inner tray as the inner tray moves from the first position to the second position. When the inner tray is in the first position, the bend may reside at the interface between the first and second portions of the cover member. That is, the first portion of the cover member may completely overlie the inner tray and then bend away from the inner tray in the region where the first portion interfaces with the second portion of the cover member. The bend in the cover member may be approximately 180 degrees, when the inner tray is in the first position.

In some embodiments, the second portion of the cover member is affixed to a portion of the outer sleeve positioned proximate to the first open end of the outer sleeve.

The first portion of the cover member may be permanently affixed to a portion of the inner tray. The first portion of the cover member may be permanently affixed to a back portion of the inner tray. For example, the first portion of the cover member may be permanently affixed to a back wall of the inner tray or a flange extending along an upper edge of the back wall of the inner tray. Such arrangements can help to ensure that the cover member cannot be completely removed from the inner tray.

In the container or containers of the present disclosure described above the inner tray is disposed within the outer sleeve. Therefore, such containers are supplied to a user in a fully assembled condition, where the inner tray is disposed within the outer sleeve. However, the present disclosure also contemplates arrangements whereby the inner tray is initially supplied separately from the outer sleeve and a user inserts the inner tray into the interior of the outer sleeve to form the fully assembled container.

According to the present disclosure, there is provided a kit of parts comprising an outer sleeve and an inner tray configured to be received in the outer sleeve to form a container of the present disclosure. The kit of parts also comprises a cover member. The kit of parts may comprise one or more instructions. The instructions may contain instructions for how to insert the inner tray into the outer sleeve to form the fully assembled container. The instructions may contain instructions for how to affix the second portion of the cover member to the outer sleeve, and how to place the first portion of the cover member on the inner tray. Providing the container in the form of a kit of parts may be advantageous from a manufacturing perspective, because it means that a step of inserting the inner tray into the outer sleeve can be performed by a user.

The present disclosure also concerns one or more laminar blanks for forming at least one of the outer sleeve and inner tray of the container described above. Therefore, according to some embodiments of the present disclosure, there is provided a first laminar blank for forming the outer sleeve. There may also be provided a second laminar blank for forming the inner tray. The outer sleeve may be formed of a single laminar blank. The inner tray may be formed of a separate single laminar blank.

As noted above, containers according to the invention are preferably formed from one or more folded laminar blanks. The one or more laminar blanks may be formed from any suitable material or combination of materials including, but not limited to, cardboard, paperboard, plastic, metal, or combinations thereof. The different components of the container may be formed from the same material, or from different materials. Each of the one or more laminar blanks may be laminar cardboard blank having a weight of between about 100 grams per square metre and about 350 grams per square metre. In preferred embodiments, the blank has a thickness of from about 100 micrometres to about 500 micrometres, preferably from about 200 micrometres to about 350 micrometres.

The container is preferably a rectangular parallelepiped comprising two wider walls (top and bottom) spaced apart by two narrower side walls. Containers according to the invention may be in the shape of a rectangular parallelepiped, with right-angled longitudinal and right-angled transverse edges. The container may comprise one or more rounded longitudinal edges, rounded transverse edges, bevelled longitudinal edges or bevelled transverse edges, or combinations thereof. The shape of the container may be defined by the shape of the outer sleeve.

The container may comprise a plurality of consumer goods. The consumer goods may be aerosol-generating articles. The aerosol-generating articles may be filter cigarettes or other smoking articles in which an aerosol-generating substrate comprises a tobacco material that is combusted to form smoke. The aerosol-generating articles may be articles in which a tobacco material is heated to form an aerosol, rather than combusted. The aerosol-generating articles may be articles in which a nicotine-containing aerosol is generated from a tobacco material, tobacco extract, or other nicotine source, without combustion, and in some cases without heating, for example through a chemical reaction.

The aerosol-generating articles may be provided within the container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which aerosol-generating articles can be removed when the inner tray is in the second position.

Through an appropriate choice of the dimensions, containers according to the invention may be designed to hold different total numbers of aerosol-generating articles, or different arrangements of aerosol-generating articles. For example, through an appropriate choice of the dimensions, containers according to the invention may be designed to hold a total of between ten and thirty aerosol-generating articles. The aerosol-generating articles may be arranged in different collations, depending on the total number.

The invention will now be further described, by way of example only, with reference to the accompanying drawings in which:

FIG. 10 shows an elevated view of an inner tray for a container according to the first embodiment of the present invention;

Figure 1C:
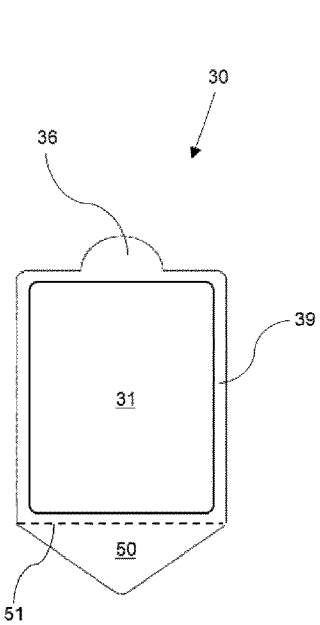
FIG. 1A shows a laminar blank for forming an outer sleeve of a container according to a first embodiment of the present invention.
FIG. 1B shows an elevated view of a cover member for a container according to the first embodiment of the present invention.
Figure 1B:
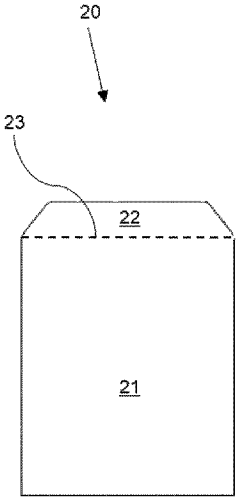
Figure 1A:
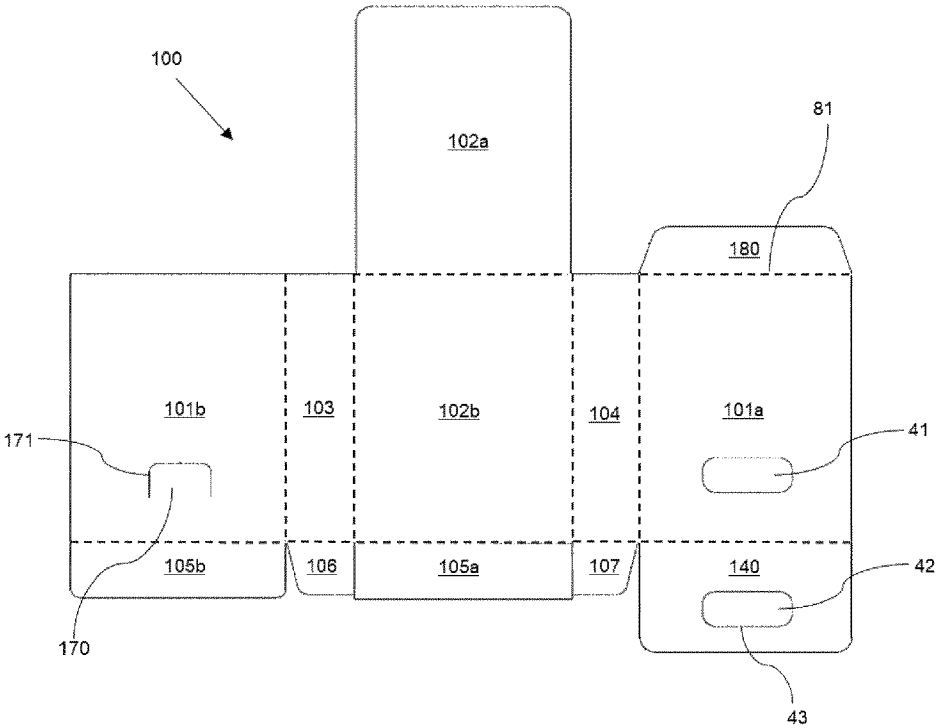
Figure 2:
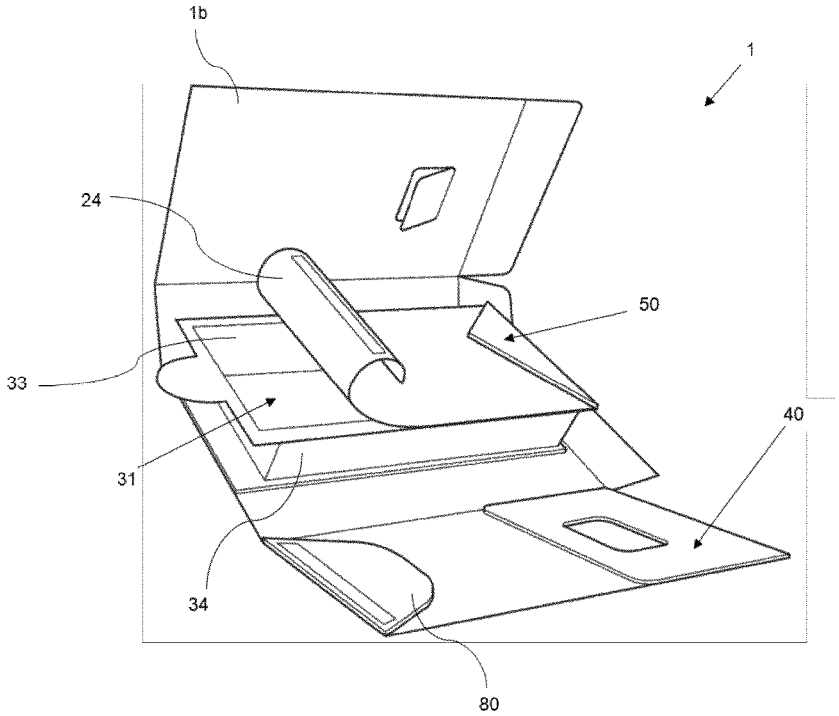
FIG. 2 shows a perspective view of the container according to the first embodiment of the present invention in a partially assembled condition.

FIG. 1A show a laminar blank 100 for forming an outer sleeve of a container 1 according to the present invention. The laminar blank can be used to form the outer sleeve a container 1 as shown in FIGS. 3, 4A, 4B and 4C. FIG. 1B shows an elevated view of a cover member 20 for a container 1 according to the first embodiment of the present invention. FIG. 10 shows an elevated view of an inner tray 30 for a container 1 according to the first embodiment of the present invention.

The dashed lines indicate fold lines, and solid lines indicate cut lines in the laminar blank 100. The laminar blank 100 comprises a first outer sleeve top wall panel 101*a*, a second outer sleeve top wall panel 101*b*, a first outer sleeve bottom wall panel 102*a*, a second outer sleeve bottom wall panel 102*b*, first and second outer sleeve side wall panels 103, 104, a first outer sleeve back wall panel 105*a*, a second outer sleeve back wall panel 105*b*, and first and second outer sleeve reinforcing flaps 106, 107. These panels together form the general structure of the outer sleeve 10. The assembled outer sleeve 10 comprises a first open end 8.

The laminar blank 100 also includes an engaging panel 140 which depends from the first outer sleeve top wall panel 101*a* by a fold line. The engaging panel 140 forms an engaging element 40 on the inner surface of the outer sleeve top wall, when the container is assembled. The engaging panel 140 comprises an internal cut-out 42, which defines an engaging edge 43 in the engaging panel 140. The first outer sleeve top wall panel 101*a* also comprises a corresponding cut-out 41. Cut-out 41 aligns with cut-out 42 in the assembled container, as shown in FIGS. 3, 4A, 4B and 4C. The engaging panel 140 is configured form part of a locking mechanism in the container 1, as will be described in more detail below with references to FIGS. 3, 4A, 4B and 4C.

The first outer sleeve top wall panel 101*b* comprises a portion 170 for defining a release tab 70 on the outer sleeve top wall, and in particular, in the outer surface of the outer sleeve top wall. The portion is partially delimited by an arcuate cut line 171 in the second outer sleeve top wall panel 101*b*. The release tab 70 is configured to facilitate unlocking of the locking mechanism in the container 1, as will be described in more detail below with references to FIGS. 3, 4A, 4B and 4C.

The laminar blank also includes a holding panel 180, which depends from the first outer sleeve top wall panel 101*a* by a fold line 81. The holding panel 180 forms a holding element 80 at the inner surface of the outer sleeve top wall, when the container is assembled. In the assembled container, the holding element 80 is pivotable about the fold line 81, which connects the holding panel 180 to the first outer sleeve top wall panel 10*a*. As will be described in more detail below with references to FIGS. 3, 4A, 4B and 4C, the holding element 80 is configured to prevent the inner tray 30 from sliding entirely out of the first open end 8 of the outer sleeve 10.

FIG. 1B shows a cover member 20 for the container 1. The cover member 20 comprises a first portion 21 and a second portion 22. A fold line 23 is provided at the interface between the first portion 21 and second portion 22 of the cover member 20. The fold line 23 may help to facilitate a bend 24 in the cover member 20 in the assembled container 1 (see FIG. 3).

FIG. 1C shows an elevated view of an inner tray 30 for the container 1 according to the first embodiment of the present invention. The inner tray comprises an inner tray front wall 38, an inner tray back wall 35, first and second opposed inner tray side walls 33, 34, and an inner tray bottom wall 32. These walls of the inner tray 30 together define the recessed base of the inner tray 30. The recessed base defines an interior volume 31 for housing one or more consumer goods 90.

The inner tray 30 also comprises a flange 39 extending along an upper edge of each of the inner tray front wall 38, inner tray back wall 35, and first and second opposed inner tray side walls 33, 34. The inner tray also comprises a pull tab 36 at the inner tray front wall 38. The pull tab 36 is integrally formed with the part of the flange 39, which extends along the upper edge of the inner tray front wall 38.

The inner tray also comprises an engagement flap 50. The engagement flap 50 is disposed at the back of the inner tray 30, and in particular, at the inner tray back wall 35. The engagement flap 50 depends from a fold line 51 on the part of the flange 39, which extends along the upper edge of the inner tray back wall 35. In the assembled container the rear part of the cover member 20 is affixed to the flange 39 at the back of the inner tray 30 by a permanent adhesive 62.

Figure 3:
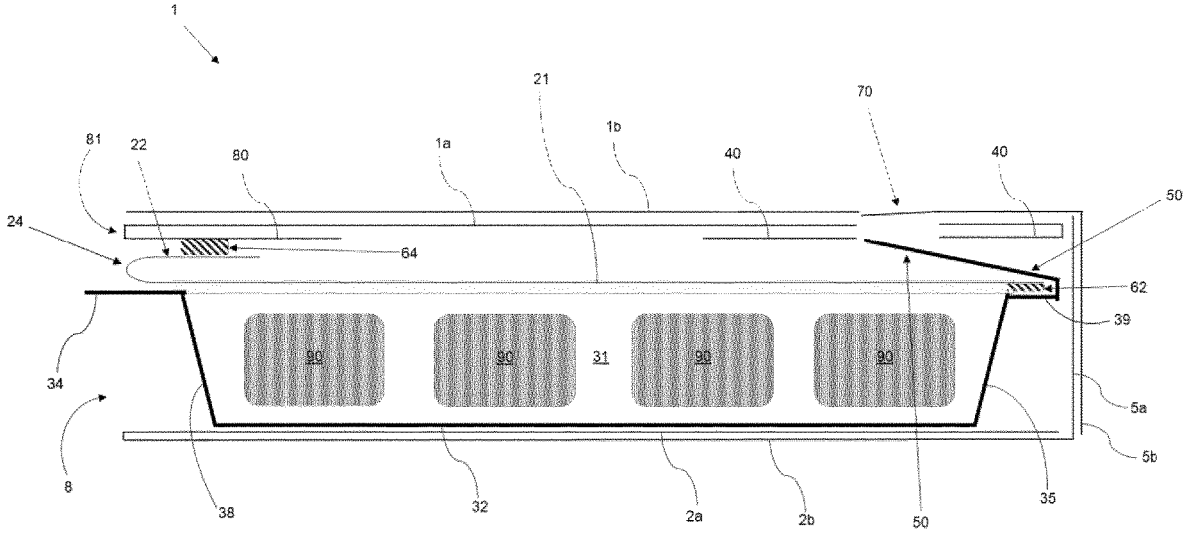
FIG. 3 shows a cross-sectional view of the container according to the first embodiment of the present invention.
Figures 4A, 4B, 4C:
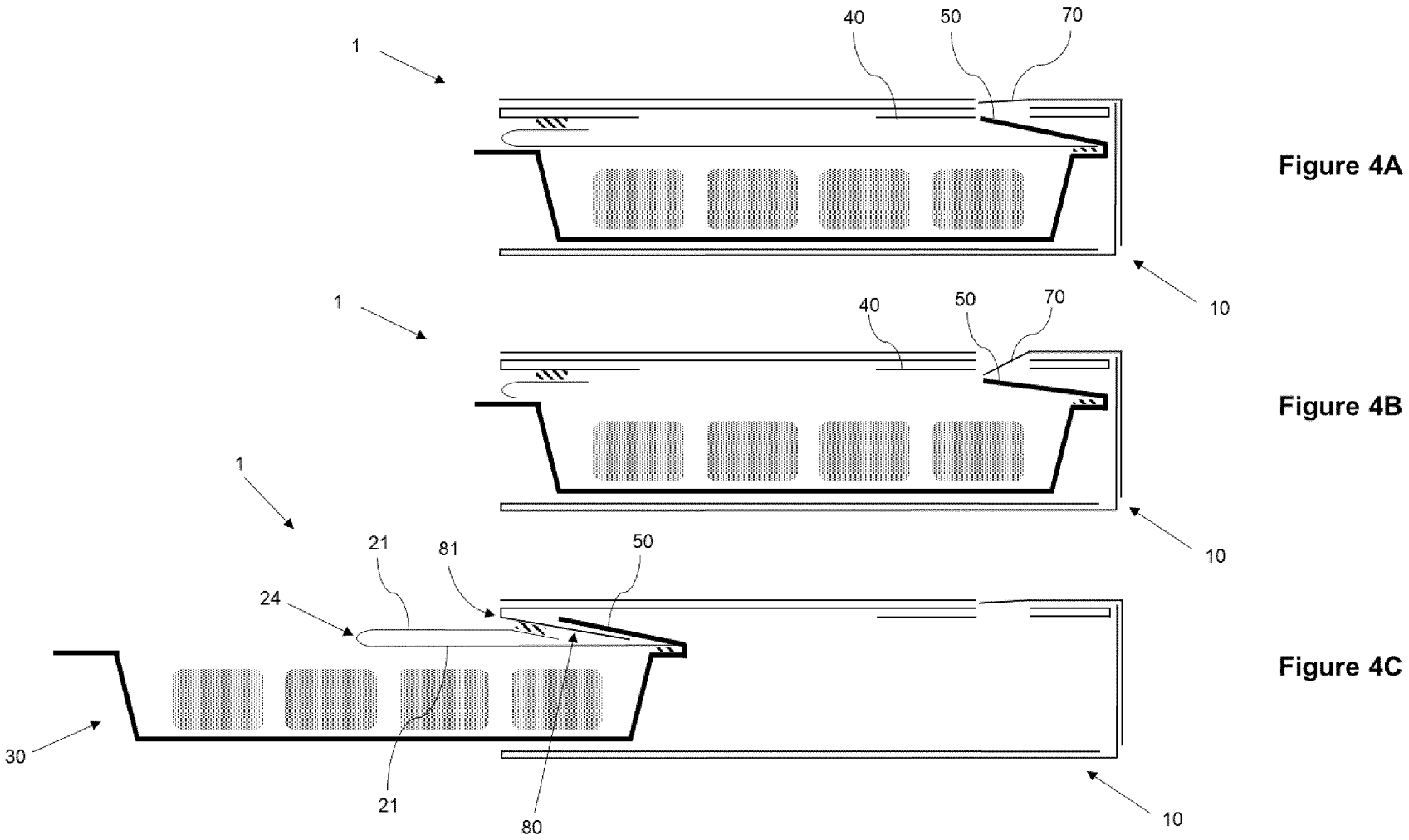
FIGS. 4A to 4C show cross-sectional views of the container according to the first embodiment of present invention in different configurations.

FIG. 3 shows a cross-sectional view of the container 1 when the inner tray 30 is in a first position in the outer sleeve 10. FIGS. 4A to 4C show cross-sectional views of the container 1 in different configurations, as the inner tray 30 transitions from the first position (as illustrated by FIGS. 3 and 4A) to a second position (as illustrated in FIG. 4C).

In the assembled container 1, the first portion 21 of the cover member 20 is configured to overlie the inner tray 30. In the assembled container 1, the second portion 22 of the cover member 20 is affixed to the inner surface of the outer sleeve top wall. In particular, the inner surface of the second portion 22 of the cover member 20 is affixed to the holding panel 180 on the inner surface of the first outer sleeve top wall panel 101*a*. The second portion 22 of the cover member 20 is affixed to the holding panel 180 by a permanent adhesive 64. As shown in FIG. 3, this arrangement creates a bend 24 in the cover member 20. When the inner tray 30 is in the first position in the outer sleeve 10, the first portion 21 of the cover member 20 completely overlies the recessed base and flange 39 of the inner tray. This creates a sealed enclosure for the consumer goods 90 in the interior volume of the recessed base.

In this first position, the engagement flap 50 of the inner tray 30 overlies the cover member 20 and engages with the engaging edge 43 of the engaging panel 40. This engagement prevents the inner tray from moving towards and through the first open end 8 of the outer sleeve 10. Therefore, in the configuration of FIG. 4A, the inner tray 30 is locked within the outer sleeve 10.

As shown in FIG. 4B, in order to unlock the inner tray 30 from this position, a user must apply pressure to the release tab 70 formed in the outer sleeve top wall. This causes the release tab 70 to be deflected towards the engagement flap 50 of the inner tray 30. The release tab 70 passes through the cut outs 41, 42 formed in the first outer sleeve top wall panel 101*a* and engaging panel 40 respectively. Further deflection of the release tab 70 towards the engagement flap 50 of the inner tray 30 causes the engagement flap 50 to move away and disengage from the engaging edge 43 of the engaging panel 40. When the engagement flap 50 is in the position shown in FIG. 4B, the inner tray is free to move towards and through the first open end 8 of the outer sleeve 10.

Therefore, in this configuration, a user may pull on the pull tab 36 of the inner tray and slide the inner tray 30 towards and through the first open end 8 of the outer sleeve 10, until the inner tray reaches the second position, as shown in FIG. 4C. As the inner tray 30 slides from the first position to the second position, the first portion 21 of the cover member 20 is pulled away from the recessed base of the inner tray 30 to expose the consumer goods 90 in the interior 31 of the recessed base. This is achieved through permanently affixing the inner surface of the second portion 22 of the cover member 20 to the outer sleeve 10.

When the inner tray 30 reaches the second position, the engagement flap 50 engages with the holding element 80 to prevent the inner tray 30 from sliding entirely out of the outer sleeve 10. In particular, the inner tray 30 moves towards the second position, the second portion 22 of the cover member 20 pulls the holding element 80 away from the outer sleeve top wall. This causes the holding element 80 to pivot about fold line 81, and create a space between the holding element 80 and the inner surface of the outer sleeve top wall. Movement of the inner tray 30 towards the second position also causes the engagement flap 50 to move into this space between the holding element 80 and the inner surface of the outer sleeve top wall. The engagement flap 50 and the holding element 80 thereby engage with one another to prevent the inner tray 30 from sliding entirely out of the outer sleeve 10.

When a user has finished accessing the consumer goods 90 in the interior 31 of the recessed base, the user can push the inner tray 30 back into the interior of the outer sleeve 10. That is, the user can slide the inner tray 30 from the second position of FIG. 4C back to the first position of FIG. 4A. Such movement causes the first portion 21 of the cover member 20 to move back over the recessed base of the inner tray 30. When the inner tray 30 reaches the first position, the engagement flap 50 can once again engage the engaging panel 40 of the outer sleeve 10, and place the container in a locked state. A resealable adhesive provided on the flange 39 of the inner tray 30 will reseal the cover member 20 to the inner tray to form a sealed enclosure for consumer goods.

The invention claimed is:

1. A container for consumer goods, the container comprising:

an outer sleeve comprising an outer sleeve top wall, an outer sleeve bottom wall, first and second opposed outer sleeve side walls, and a first open end;

an inner tray disposed within the outer sleeve, the inner tray defining a recessed base having an interior for housing consumer goods; and a cover member comprising a first portion overlying the recessed base of the inner tray, and a second portion extending beyond the recessed base and being affixed to the outer sleeve, wherein the inner tray is slidable with respect to the outer sleeve between:

a first position, in which the cover member and the recessed base form an enclosure for consumer goods; and a second position, in which the interior of the recessed base can be accessed by a user, wherein sliding of the inner tray from the first position to the second position involves at least part of the inner tray passing through the first open end of the outer sleeve and at least a portion of the cover member being peeled away from the recessed base to expose the interior of the inner tray, wherein, the inner tray further comprises an inner tray engagement flap, wherein, when the inner tray is in the first position in the outer sleeve, an edge of the inner tray engagement flap is configured to engage with a corresponding engaging element on an outer sleeve wall, to form a locking mechanism for preventing the inner tray from sliding from the first position to the second position, wherein a further engaging element on the outer sleeve wall is formed by a holding panel connected to the outer sleeve wall by a fold line at the first open end of the outer sleeve top wall, and folded around the fold line such that the holding panel is positioned under the outer sleeve top wall, wherein the holding panel has an inner surface facing the inner tray, wherein the second portion of the cover member is fixed to the inner surface of the holding panel, and wherein the corresponding engaging element on the outer sleeve wall is formed from the outer sleeve top wall and an engaging panel depending from the outer sleeve top wall by a fold line, wherein the engaging panel comprises an internal cut-out, and wherein the outer sleeve top wall comprises a corresponding cut-out.

2. The container according to claim 1, wherein the inner tray comprises an inner tray back wall, and wherein the inner tray engagement flap depends from the inner tray back wall, and is configured to overlie the cover member.

3. The container according to claim 1, wherein the engaging element of the outer sleeve is provided on the inner surface of the outer sleeve top wall.

4. The container according to claim 1, wherein the inner tray further comprises a flange extending along an upper edge of the recessed base, and wherein the first portion of the cover member overlies both the recessed base and the flange, when the inner tray is in the first position in the outer sleeve.

5. The container according to claim 1, wherein the inner tray further comprises a pull tab extending through the first open end of the outer sleeve, when the inner tray is in the first position in the outer sleeve.

6. The container according to claim 1, wherein the wall of the outer sleeve having the engaging element is further provided with a release element for enabling the edge of the inner tray engagement flap to disengage from the engaging element.

7. The container according to claim 6, wherein the release element comprises a release tab formed by at least one cut-line on the wall of the outer sleeve having the engaging element.

8. The container according to claim 6, wherein the release element overlies at least a portion of the inner tray engagement flap, when the inner tray is in the first position in the outer sleeve.

9. The container according to claim 1, wherein the container further comprises a holding mechanism for preventing the inner tray from sliding entirely out of the first open end of the outer sleeve.

10. The container according to claim 9, wherein the holding mechanism comprises the further engaging element.

11. The container according to claim 1, wherein the cover member comprises an inner surface and an outer surface, and wherein the inner surface of the first portion of the cover member faces towards the interior of the recessed base when the inner tray is in the first position, and wherein the inner surface of the second portion of the cover member is affixed to the outer sleeve.

12. The container according to claim 1, wherein the second portion of the cover member is affixed to a portion of the holding panel of the outer sleeve positioned proximate to the first open end of the outer sleeve.

13. The container according to claim 1, wherein the outer sleeve top wall is formed from a first panel and a second panel overlying the first panel.

14. The container according to claim 13, wherein the corresponding cut-out is formed in the first panel and a cut-line is formed in the second panel.

15. The container according to claim 1, wherein the inner tray and the outer sleeve are configured such that the recessed base of the inner tray resides completely within the outer sleeve when the inner tray is in the first position.

16. A container for consumer goods, the container comprising:

an outer sleeve comprising an outer sleeve top wall, an outer sleeve bottom wall, first and second opposed outer sleeve side walls, and a first open end;

an inner tray disposed within the outer sleeve, the inner tray defining a recessed base having an interior for housing consumer goods; and a cover member comprising a first portion overlying the recessed base of the inner tray, and a second portion extending beyond the recessed base and being affixed to the outer sleeve, wherein the inner tray is slidable with respect to the outer sleeve between:

a first position, in which the cover member and the recessed base form an enclosure for consumer goods; and a second position, in which the interior of the recessed base can be accessed by a user, wherein sliding of the inner tray from the first position to the second position involves at least part of the inner tray passing through the first open end of the outer sleeve and at least a portion of the cover member being peeled away from the recessed base to expose the interior of the inner tray, wherein, the inner tray further comprises an inner tray engagement flap, wherein, when the inner tray is in the first position in the outer sleeve, an edge of the inner tray engagement flap is configured to engage with a corresponding engaging element on an outer sleeve wall, to form a locking mechanism for preventing the inner tray from sliding from the first position to the second position, wherein a further engaging element on the outer sleeve wall is formed by a holding panel connected to the outer sleeve wall by a fold line at the first open end of the outer sleeve top wall, and folded around the fold line such that the holding panel is positioned under the outer sleeve top wall, wherein the holding panel has an inner surface facing the inner tray, wherein the second portion of the cover member is fixed to the inner surface of the holding panel; and wherein the outer sleeve top wall is formed from a first panel and a second panel overlying the first panel, and wherein the corresponding engaging element on the outer sleeve wall is formed from the first panel, the second panel, and an engaging panel depending from the first panel or second panel by a fold line.

* * * * *